US009617723B2

(12) United States Patent
Stonecipher et al.

(10) Patent No.: US 9,617,723 B2
(45) Date of Patent: Apr. 11, 2017

(54) TRENCH DRAIN

(71) Applicants: Scott Stonecipher, Jackson, TN (US); Will Rice, Auburn, AL (US); Richard Millard, Gladehill, VA (US)

(72) Inventors: Scott Stonecipher, Jackson, TN (US); Will Rice, Auburn, AL (US); Richard Millard, Gladehill, VA (US)

(73) Assignee: Midwest Industrial Leasing, LLC, Clifton, TN (US)

( * ) Notice: Subject to any disclaimer, the term of this patent is extended or adjusted under 35 U.S.C. 154(b) by 311 days.

(21) Appl. No.: 13/912,595

(22) Filed: Jun. 7, 2013

(65) Prior Publication Data

US 2013/0326806 A1 Dec. 12, 2013

Related U.S. Application Data

(60) Provisional application No. 61/656,668, filed on Jun. 7, 2012.

(51) Int. Cl.
*E03F 5/04* (2006.01)
*E03F 5/06* (2006.01)

(52) U.S. Cl.
CPC ..... *E03F 5/0408* (2013.01); *E03F 5/06* (2013.01); *E03F 2005/068* (2013.01); *Y10T 29/49826* (2015.01)

(58) Field of Classification Search
CPC ..... E03F 5/0408; E03F 5/0407; E03F 5/04; E03F 2005/068; E03F 5/06; A47K 3/40; A47K 3/405; E04F 15/02188; E04B 1/7023
USPC ..... 4/613, 612, 679; 52/302.3; 137/362
See application file for complete search history.

(56) References Cited

U.S. PATENT DOCUMENTS

| | | | | |
|---|---|---|---|---|
| 1,561,120 | A * | 11/1925 | Smith | 210/164 |
| 2,757,385 | A * | 8/1956 | Whittick | 4/613 |
| 8,474,069 | B1 * | 7/2013 | Whitinger | 4/613 |
| 9,322,157 | B1 * | 4/2016 | Ismert | E03F 5/0407 |
| 2004/0028470 | A1 * | 2/2004 | Boudreau | E03F 5/06 404/26 |
| 2004/0049846 | A1 * | 3/2004 | Cornwall | E03F 5/042 4/679 |
| 2011/0061161 | A1 * | 3/2011 | Erlebach | 4/679 |
| 2011/0162137 | A1 * | 7/2011 | Kik et al. | 4/613 |
| 2011/0197355 | A1 * | 8/2011 | Lemire | 4/613 |
| 2012/0037553 | A1 * | 2/2012 | Silverstein | E03F 5/0407 210/163 |

(Continued)

FOREIGN PATENT DOCUMENTS

| | | | | |
|---|---|---|---|---|
| EP | 1630309 | * | 3/2006 | E03F 5/0408 |
| EP | 1992748 | * | 11/2008 | E03F 5/06 |

*Primary Examiner* — J. Casimer Jacyna
(74) *Attorney, Agent, or Firm* — Wayne Edward Ramage; Baker Donelson

(57) ABSTRACT

A trench drain with a trench body and a grate for use with a flush-threshold or low-threshold shower. The trench body is rectangular, with a drain hole positioned in the bottom. Front and back flanges extend from the bottom of the front and back sides for an absolute flush installation of the trench drain to the shower body and the bathroom flooring. The trench body may extend under the shower walls on each side. A grate fits into the top of the trench body onto a lip or edge on the interior of the front and back sides. Protrusions may extend inward to help provide support and stability for the grate.

13 Claims, 9 Drawing Sheets

(56) References Cited

U.S. PATENT DOCUMENTS

| | | | | |
|---|---|---|---|---|
| 2012/0110827 | A1* | 5/2012 | Doolittle et al. | 29/527.1 |
| 2013/0199978 | A1* | 8/2013 | Luke | 210/163 |

* cited by examiner

TRENCH DRAIN

This application claims benefit of and priority to U.S. Provisional Application No. 61/656,668, filed Jun. 7, 2012, and is entitled to that filing date for priority. The specification, figures and complete disclosure of U.S. Provisional Application No. 61/656,668 are incorporated herein by specific reference for all purposes.

FIELD OF INVENTION

This invention relates to a trench drain. In particular, this invention relates to a trench drain for use with showers in health-care environments and settings.

BACKGROUND OF THE INVENTION

Water containment has perpetually been an issue in health-care related shower applications. Health-care settings need low threshold heights (frontal height stepping into the shower) to allow for the aged and those with limited mobility receiving health care to easily enter and exit the bathing settings, especially as they relate to showers. With a low or no threshold height, as is required by many codes such as ADA and ANSI 117.1, water has a great tendency to work its way out of the front of the shower units. This water escaping the shower causes a number of problems for the bathroom. These include slipping hazards for the bather, slipping hazards for care givers, and water damage in the bathroom and other rooms in the facility.

In certain areas, the codes related to the shower front threshold and the bathroom floor allow a ½" transition from the bathroom floor to the inside top of the shower threshold in transfer showers (transfer showers defined as 36"×36" inside dimension) and a "flush floor" transition from the bathroom floor to the inside top of the shower threshold of roll in showers (roll in showers defined as 60"×30" ID or 60"×36" ID).

Low thresholds required by these codes also have brought challenges to the construction of these facilities. In order to meet the height relationship requirement of the shower floor and the bathroom floor, the design and construction phases must determine if they are going to build the bathroom floor up to meet the height requirements or if the shower will be recessed in its installation setting to lower the threshold height of the showers so that the bathroom floor does not have to be built up. The recess required creates many difficulties for the construction trades. Recessing in particular becomes a challenge with the trades either in small areas or for the entire shower. The challenges are the size and the placement for these recesses. The construction industry has worked to reduce the "slab" thickness on the construction sites to minimal thicknesses. With these minimal thicknesses, the recess of an area, such as an area for a shower, requires that the overall floor thickness be increased so that the recess area does not violate local building codes for construction subfloor thickness. This increases cost for the construction site. Another challenge is that many concrete prefabbed subfloors have tension cables through them. The design and construction trades are challenged with the recesses and how these recesses interfere with the tension cables. An additional challenge from both design and construction is cost, in that many designers and caregivers as well as shower manufactures require an additional floor drain in the bath room. This is a result of water escaping the shower.

Showers must be designed to drain water. In order to drain water, draft must be designed into the shower. The draft must be such that enough slope exists to direct water towards the drain. Traditional low threshold showers have center drain placement. This center drain placement optimizes the ability for a manufacturer to reduce the overall height of the shower floor by minimizing the "height" of the shower floor due to the needed draft. With the center drain placement, draft typically is created 360° around the drain. This draft coming from so many directions creates difficulties for both the manufacturer (or tile craftsman) and the installers in the construction setting due to trying to support the floor of the shower in so many directions with different "thicknesses" of support material under the shower floor. The thicknesses tend to vary and provide high spots that reduce or eliminate the intended draft or it creates voids that result in fracturing and failure in the shower floor. Both of these scenarios are extremely frequent in the installation of low threshold showers.

In addition, low threshold shower manufacturers design products with minimal material thickness of support material under the shower body to attempt to alleviate the challenge with the bathroom-to-shower threshold thickness challenge. These lower supported shower floors have systemic problems of bowing, warping and not maintaining their designed draft. These shower floors also tend to take the shape of the supporting material that the installation trades use, and, again, affects the designed draft of the shower floors. The result of this affected draft is either water puddling in the shower floor or, more likely, water being forced out of the shower due to not reaching the drain and being redirected out of the shower into the bathroom floor.

Additionally, shower floors designed with center drains frequently interfere with the subfloor support members such as the tension cables and "I" beams. The traditional methods of manufacturing shower products in modular settings prevents drain placements from being moved, and thus construction challenges result. In tile applications for showers, drain placement can be moved, but in order to move the drain, the draft is affected. In order to achieve the intended draft, the shower threshold must go up which again means more recess or it means the bathroom floor overall must be increased.

The requirements for the relationship of the shower threshold and the bathroom floor also are not familiar to many of the trades involved during the construction phase. This unfamiliarity often results in installation of the shower and the bathroom floor in more traditional ways that do not result in shower thresholds and bathroom floors that are dimensionally compliant.

Further, the mending points for the shower and the bathroom floor are challenges for the trade personnel creating the bathroom floor, for the cleaning crew of the health-care facility, and for water damage. The traditional transition between the shower threshold and bathroom creates a joint that provides for a mending point that is not handled well by the installation tradespeople. That is, the mending material (typically either grout or flooring material) does not secure well to the mending area. This often provides an inconsistent seal that does not work well functionally or aesthetically. Additionally, shower thresholds often are made with radii on the front that are ⅜" or greater in size. This creates an additional challenge in the flush floor installation for the mending of the bathroom flooring material and the shower threshold.

While lower threshold shower systems do exist, they continue to have several problems. The drains have substandard draft and draining capabilities. The drain does not reach under the shower walls, thereby allowing water to snake by the capturing points. The grate has solid connections that extend from the front to the back of the trench, thereby creating interruptions in the water capture points and also allowing water to snake by the capturing points. Further, the radii are large and do not allow good mending points in conjunction with the finished flooring. And finally, these lower threshold systems still have a threshold height greater than 1 inch.

Accordingly, what is needed is an improved trench drain that does not have the problems noted above.

SUMMARY OF INVENTION

In various embodiments, the present invention comprises a trench drain with a trench body and a grate. In some embodiments, the trench body is rectangular, with a bottom, a front side or edge, a back side or edge, and two ends. A drain hole is positioned in the bottom. The drain hole may be positioned in or near the center of the bottom, but also may be located at other positions along the bottom.

Front and back flanges extend from the bottom of the front and back sides, respectively, of the trench body. This allows for an absolute flush installation of the trench drain (such as by inserting screws through screw-holes on the flanges) to the shower body, as well as an absolute flush installation of the trench drain to the bathroom flooring in front of the trench drain. The flanges may be 90° in profile, thereby addressing and resolving the problems in mending the shower threshold and bathroom floor, as discussed above.

In one exemplary embodiment, the front flange is a ⅛" frontal horizontal flange used to secure the trench to the construction floor. This thickness provides structural support to prevent the threshold and/or drain from warping. In prior art shower installations, there is opportunity for warping on the front of the threshold of the shower, which warping greatly affects the ability for trade personnel to mend the seam between the shower floor and the bathroom floor. This reduces the efficacy of the drain. In addition, the front horizontal flange of this embodiment has countersunk holes allowing trade personnel to secure this trench to the construction floor or bathroom subfloor. Securing this flange ensures the threshold is horizontal and flat. Water flows to the lowest point, so the present invention's installation enables optimum draining ability due to ensuring the structure, levelness, and flatness of the installation, as well as the security of fixing the trench drain in place.

In one exemplary embodiment, the trench body is long enough to extend under the vertical shower walls on each side. In one embodiment, the body extends under the vertical shower walls by ⅛" on each side. End flanges may extend from the ends of the trench body for this purpose, and may be secured in place. This eliminates any potential for water "snaking" around the edges.

A grate fits into the top of the trench body onto a lip or edge on the interior of the front and back sides. Protrusions may extend inward to help provide support and stability for the grate. The protrusions may be curved so as to not impede water flow. The grate may be stainless steel, plastic, or other suitable material. In one embodiment, the grate has 21 lateral supports and 20 openings, all continuous, to optimize water capture.

In several embodiments, the grate does not have solid connections that extend from the front to the back of the trench drain, thereby avoiding interruptions in the water capture points and also preventing water from snaking by the capturing points. The top of the longitudinal supports are higher than the lateral supports, thereby avoiding a continuous solid connection between the back and the front of the trench drain.

The trench body has a drafted inside slope enabling water to move quickly from the left and right sides of the trench towards the drain hole. The outside bottom of the trench body may be flat, allowing it to be installed completely on the subfloor with no need to use bedding compound or mudset.

While the trench drain may be located at various locations within a shower, in one exemplary embodiment, the trench drain is installed at the front of the shower. Thus, all the draft in the shower goes to the front, eliminating the need for understanding or dealing with shower draft. The drain hole can be moved to the left or right (as noted above with regard to positioning in the bottom) in order to miss I-beam or other subfloor obstructions. This positioning also minimizes the number of transition points (transition from bathroom floor to trench drain, and from trench drain to shower floor/body), thereby making installation easier and reducing drainage and installation problems.

In some embodiments, with an absolute front location, the trench drain may serve as the drain for the entire bathroom. In other systems, a drain is located somewhere back into the shower some distance, creating several transitions (bathroom floor to shower floor, shower floor to drain) that impede proper mending and the ability for water to be directed to the drain properly.

DETAILED DESCRIPTION OF EXEMPLARY EMBODIMENTS

Figure 1:
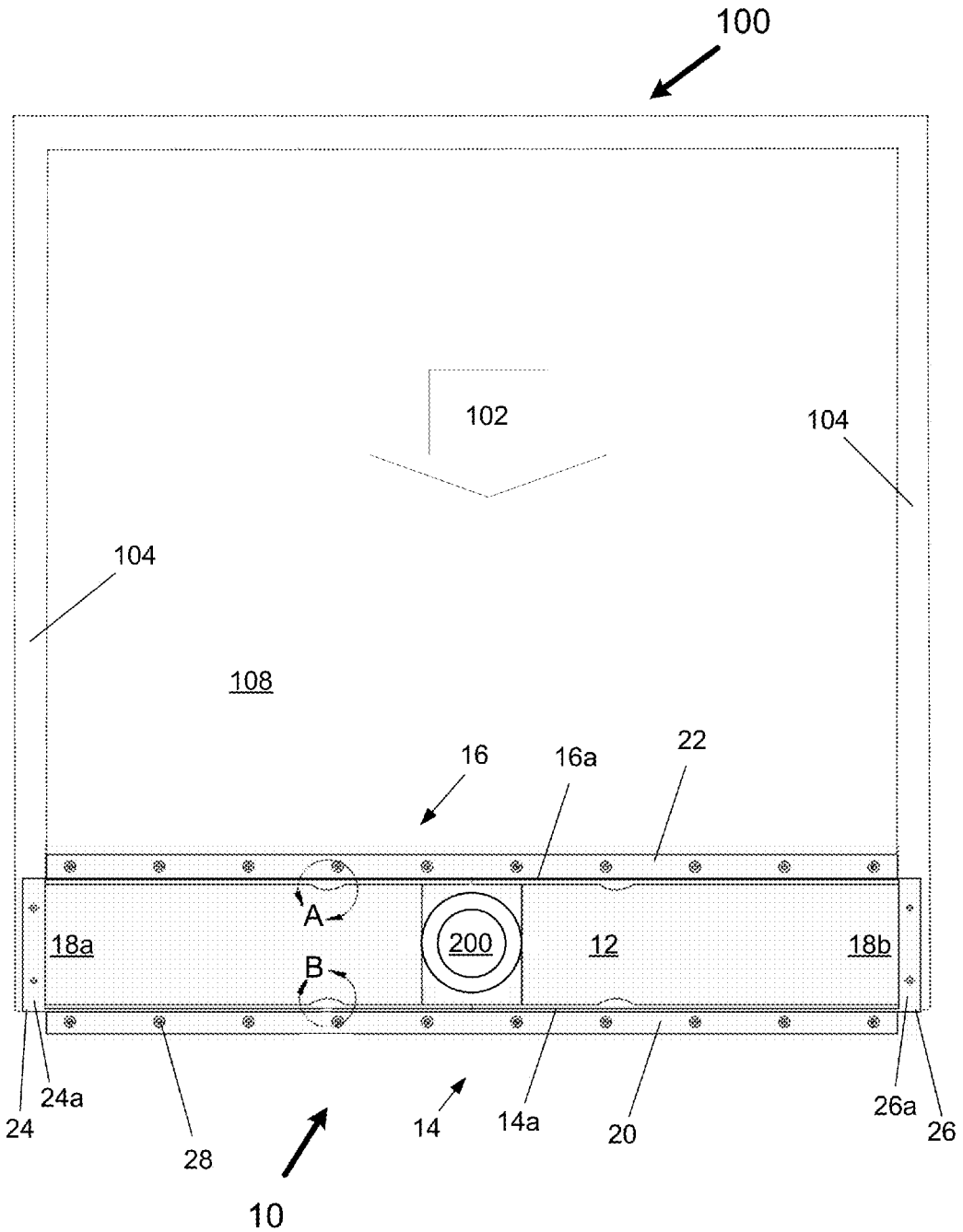
FIG. 1 shows a top view of a trench body installed in a shower.
Figure 2:
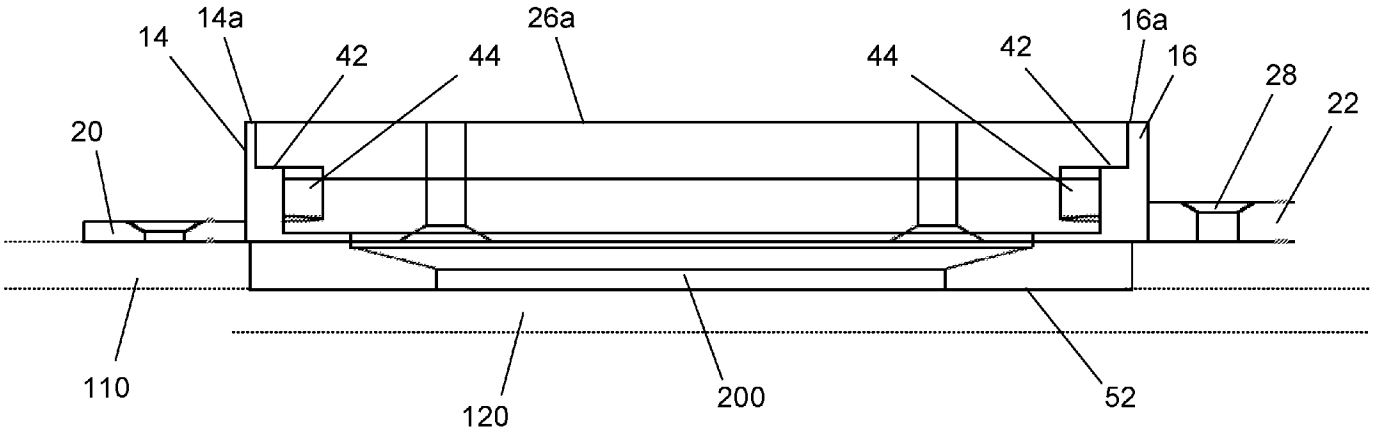
FIG. 2 shows a cross-section of the trench body of FIG. 1.
Figure 3:
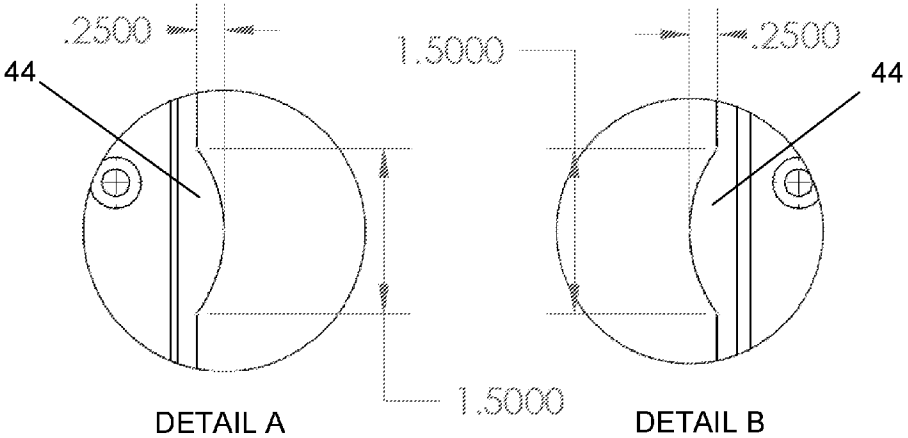
FIG. 3 shows details A and B of the grill-support protrusions of FIG. 1.
Figure 4:
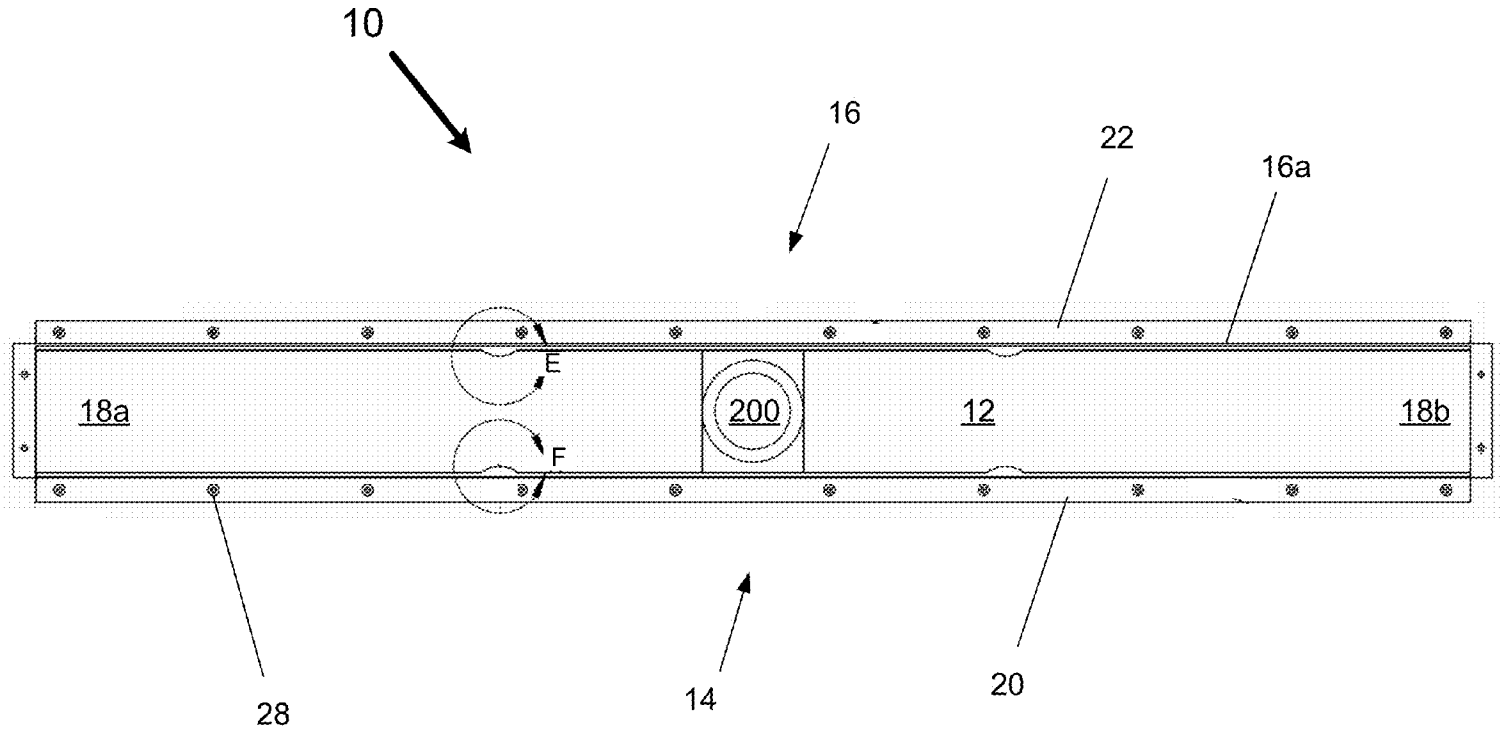
FIG. 4 shows a top view of an alternative embodiment of a trench body.
Figure 5:
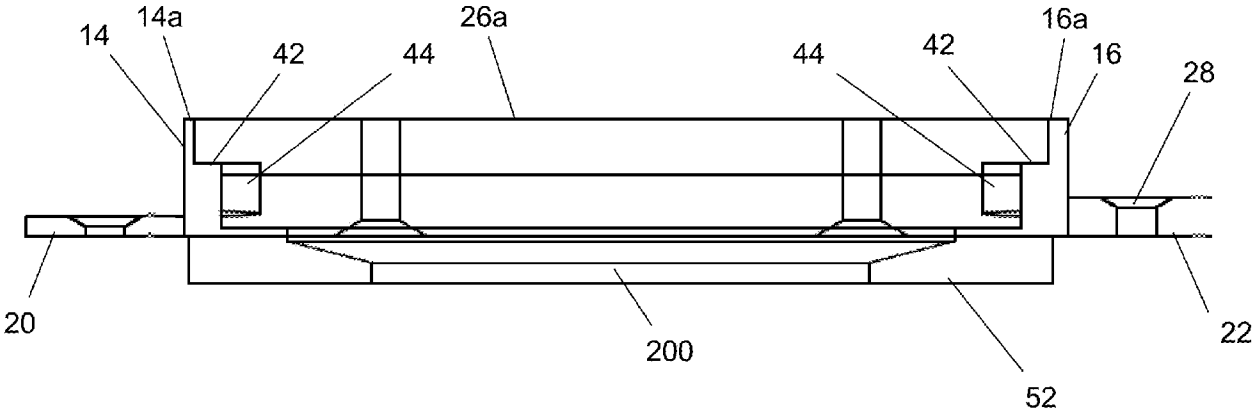
FIG. 5 shows a cross-section of the trench body of FIG. 4.
Figure 6:
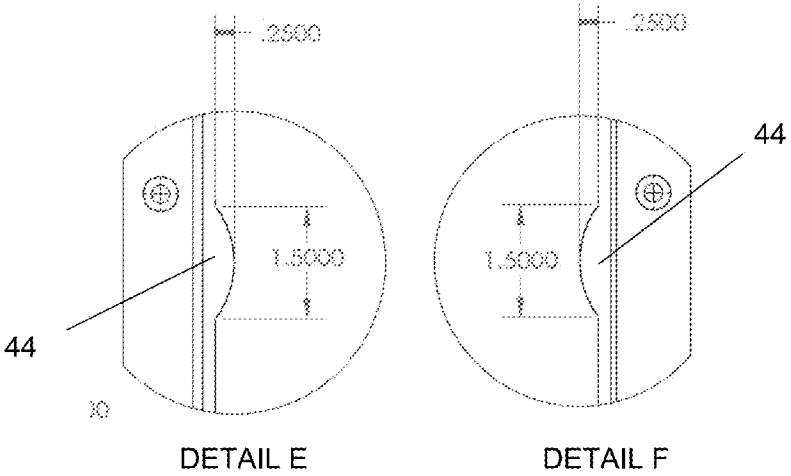
FIG. 6 shows details E and F of the grill-support protrusions of FIG. 4.

In various exemplary embodiments, the present invention comprises a trench drain comprising a unitary (i.e., forming a single unit) trench body 10 with a removable or detachable grate 40. In the embodiments shown in FIGS. 1-8, the trench body 10 is rectangular, with an open top, a bottom 12, a front side or edge 14 with a top 14*a*, a back side or edge 16 with a top 16*a*, and two ends 18*a, b*. A drain hole 200 is positioned in the bottom. The drain hole may be positioned in or near the center of the bottom, but also may be located at other positions along the bottom.

Front 20 and back 22 flanges extend from the top or bottom of the front and back sides, respectively, of the trench body. This allows for an absolute flush installation of the trench drain (such as by inserting screws through screw-holes 28 on the flanges) to the shower body, as well as an absolute flush installation of the trench drain to the bathroom flooring in front of the trench drain. In one embodiment, the flanges are 90° in profile to the trench body, and the front and back of the trench have a 90° profile, thereby allowing an absolute flush installation as discussed above, and addressing and resolving the problems in mending the shower threshold and bathroom floor, as discussed above.

In one exemplary embodiment, the front flange 20 is a ⅛" frontal horizontal flange used to secure the trench to the construction floor 110. This thickness provides structural support to prevent the threshold and/or drain from warping. In prior art shower installations, there is opportunity for warping on the front of the threshold of the shower, which warping greatly affects the ability for trade personnel to mend the seam between the shower floor 108 and the bathroom floor. This reduces the efficacy of the drain. In addition, the front horizontal flange 20 of this embodiment has countersunk holes 28 allowing trade personnel to secure this trench to the construction floor 110. Securing this flange ensures the threshold is horizontal and flat. Water flows to the lowest point, so the present invention's installation enables optimum draining ability due to ensuring the structure, levelness, and flatness of the installation, as well as the security of fixing the trench drain in place.

In one exemplary embodiment, the trench body is long enough to extend under the vertical shower walls on each side so that water capturing points (e.g., the open top with grill in place) extend all the way to the shower walls. This is an improvement over the prior art, where the water capturing points do not extend to or reach under the shower walls, allowing water to "snake" around the ends. In one embodiment, the body extends under the vertical shower walls by ⅛" on each side. End flanges 24, 26 may extend from the ends of the trench body to help secure the drain body in place. This design eliminates any potential for water "snaking" around the edges or ends of the drain. As seen in FIGS. 1, 2, 4, 5 and 7, the tops 24*a*, 26*a* of the end flanges may be level and contiguous with the tops 14*a*, 16*a* of the front and back sides or edges.

A grate 40 fits into the top of the trench body onto a lip or edge 42 on the interior of the front and back sides. Protrusions 44 may extend inward to help provide support and stability for the grate 40. In the embodiment shown in FIGS. 3A and 3B, the protrusions are curved so as to not impede water flow. The grate may be stainless steel, plastic, or other suitable material. In one embodiment, the grate has 21 lateral supports and 20 openings, all continuous, to optimize water capture.

Figure 10:
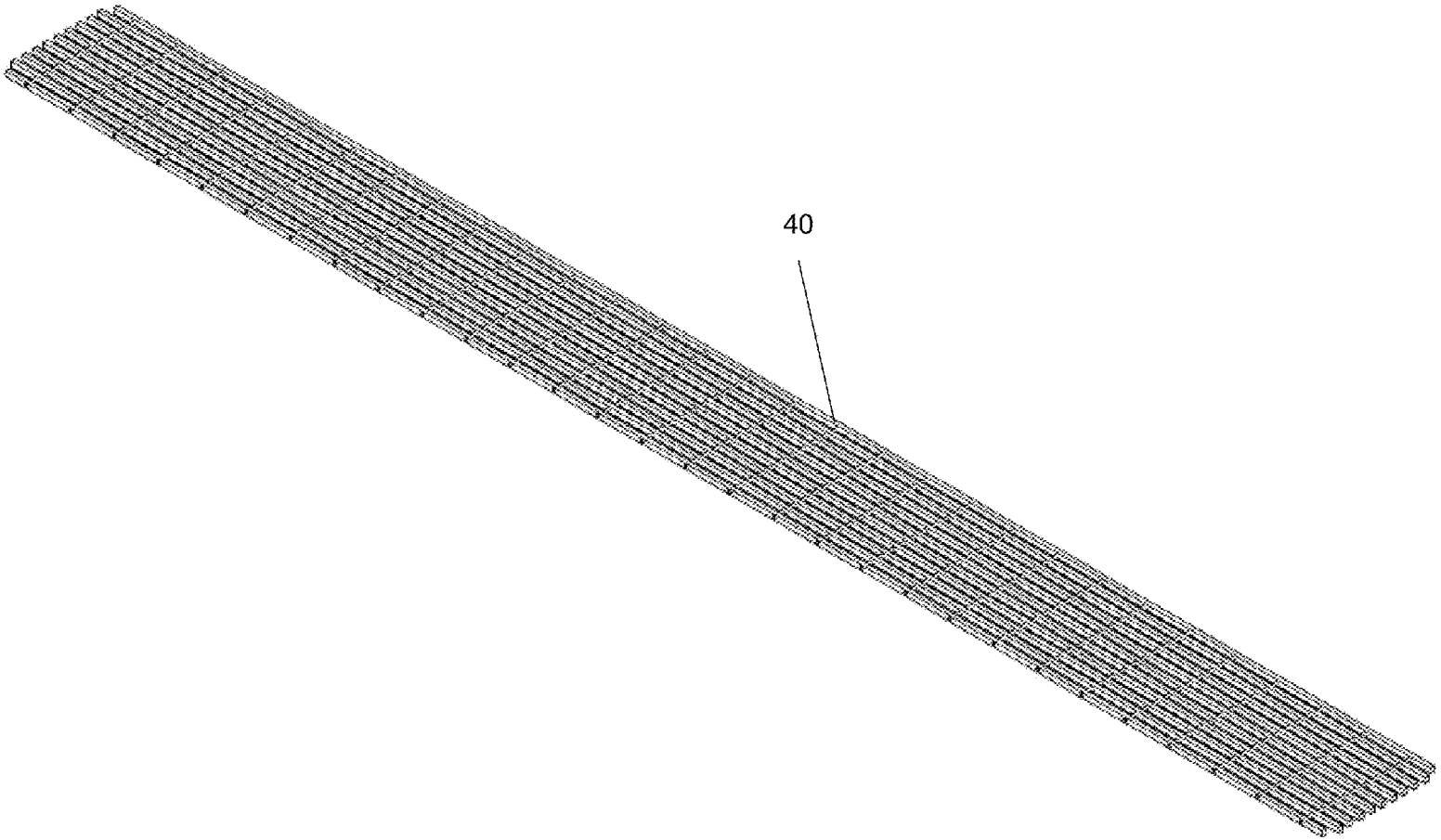
FIG. 10 shows another perspective view of a drain grate.

In several embodiments, the grate does not have solid connections that extend from the front to the back of the trench drain, thereby avoiding interruptions in the water capture points and also preventing water from snaking by the capturing points. As seen in FIG. 10, the top of the longitudinal supports are higher than the lateral supports, thereby avoiding a continuous solid connection between the back and the front of the trench drain.

Figure 7:
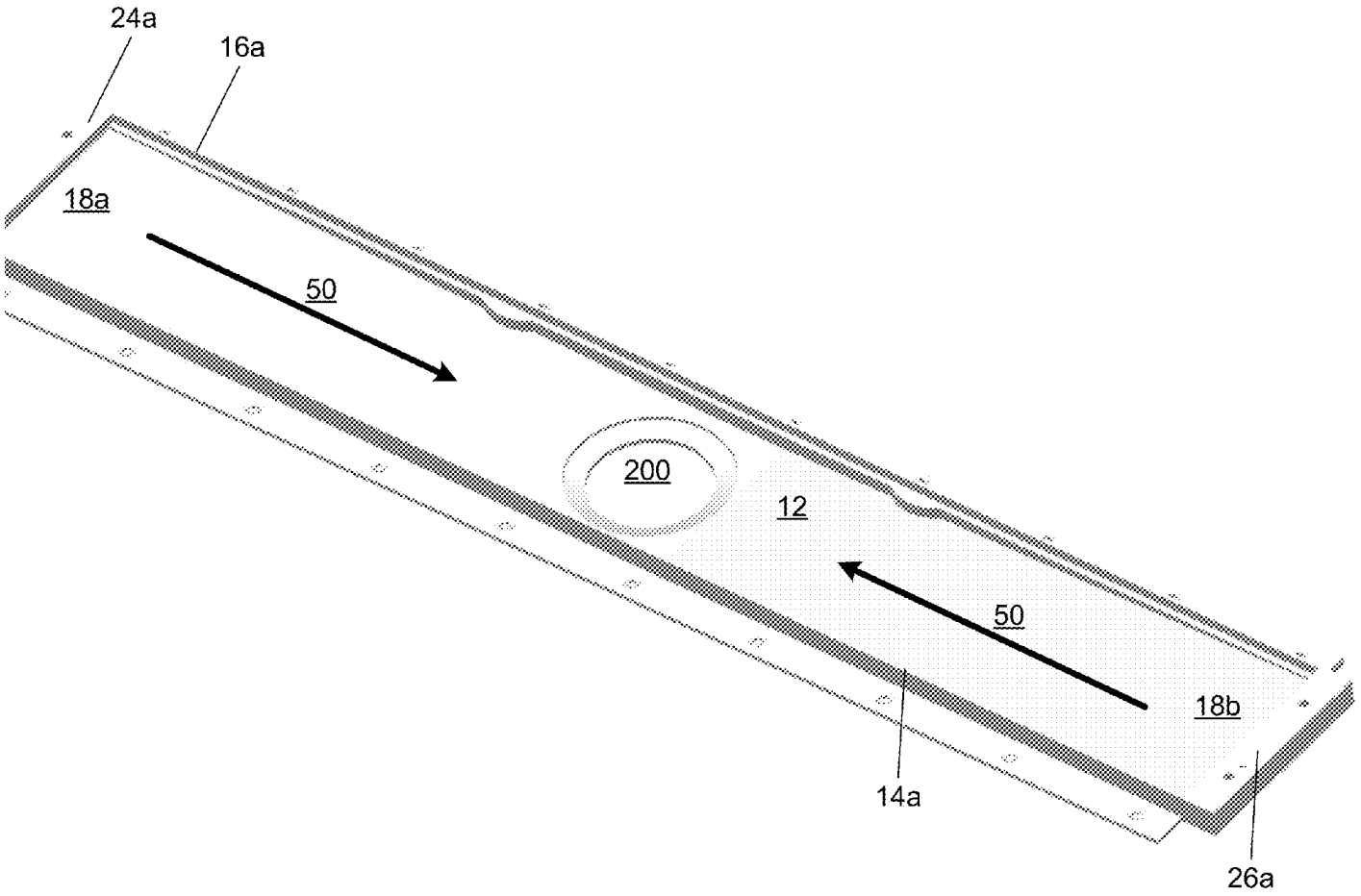
FIG. 7 shows a perspective view of a trench body.
Figure 8:
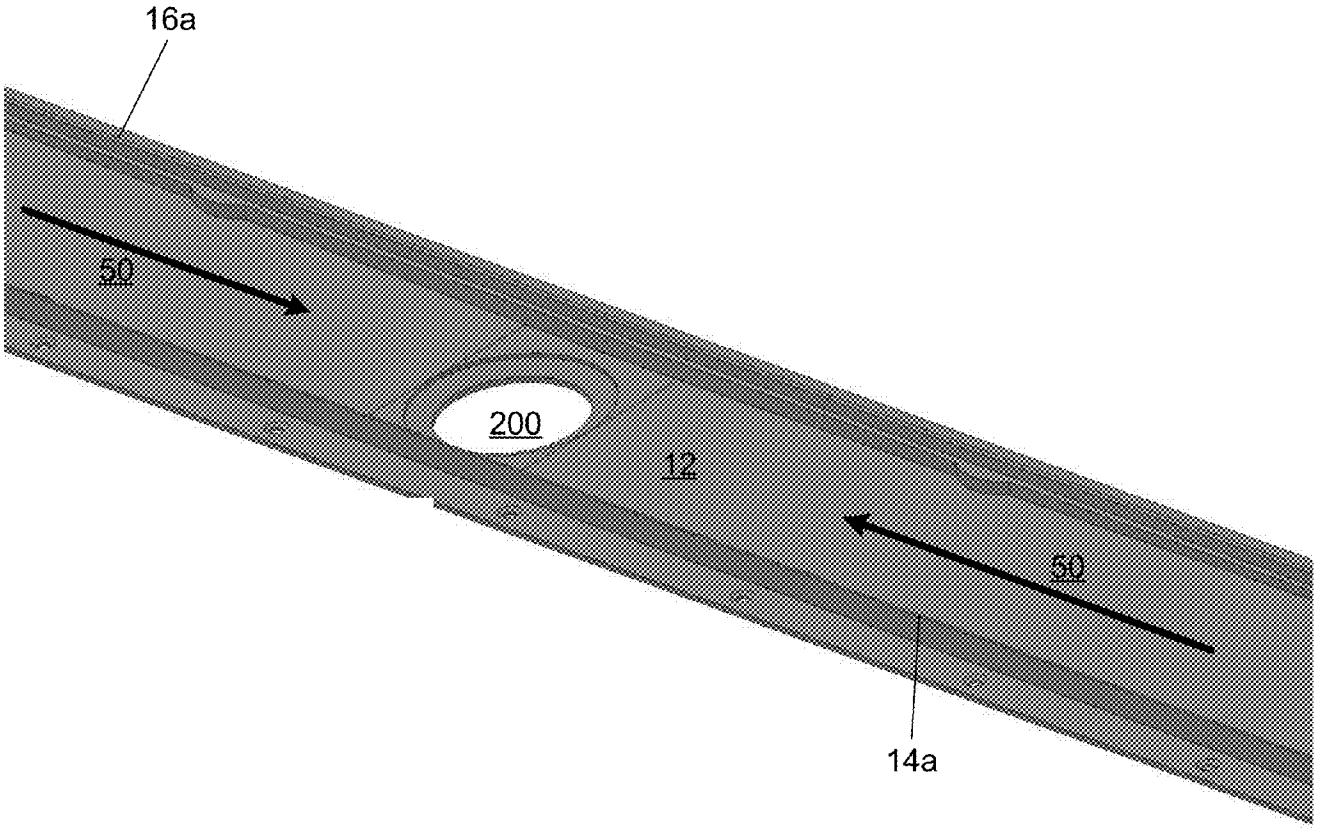
FIG. 8 shows a perspective view of the center portion of a trench body.
Figure 9:
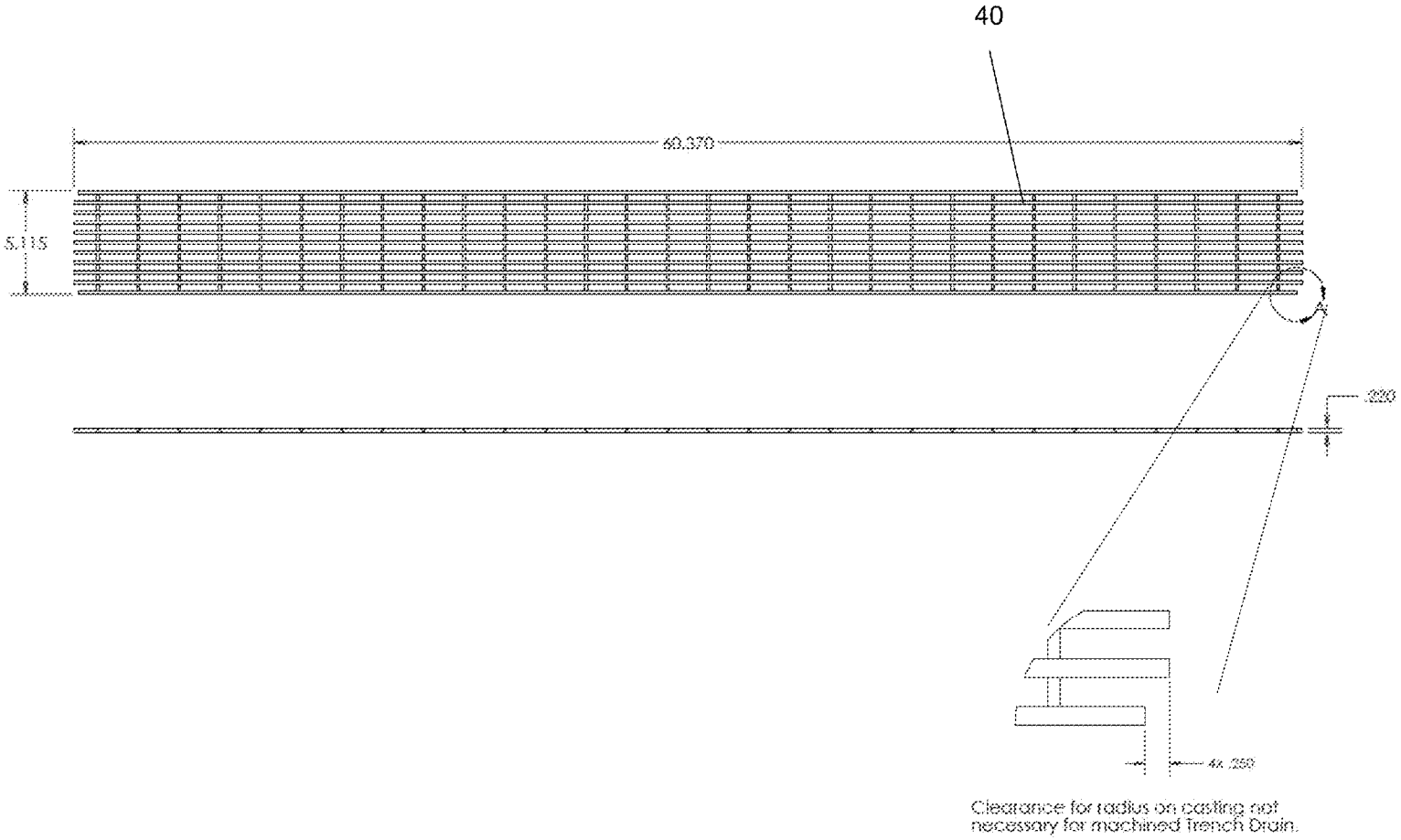
FIG. 9 shows a perspective view of a drain grate.

The trench body has a drafted inside slope 50, as seen in FIGS. 7 and 8, enabling water to move quickly from the left and right sides of the trench towards the drain hole 200. The outside bottom 52 of the trench body may be flat, allowing it to be installed completely on the subfloor 120 with no need to use bedding compound or mudset.

Figure 11:
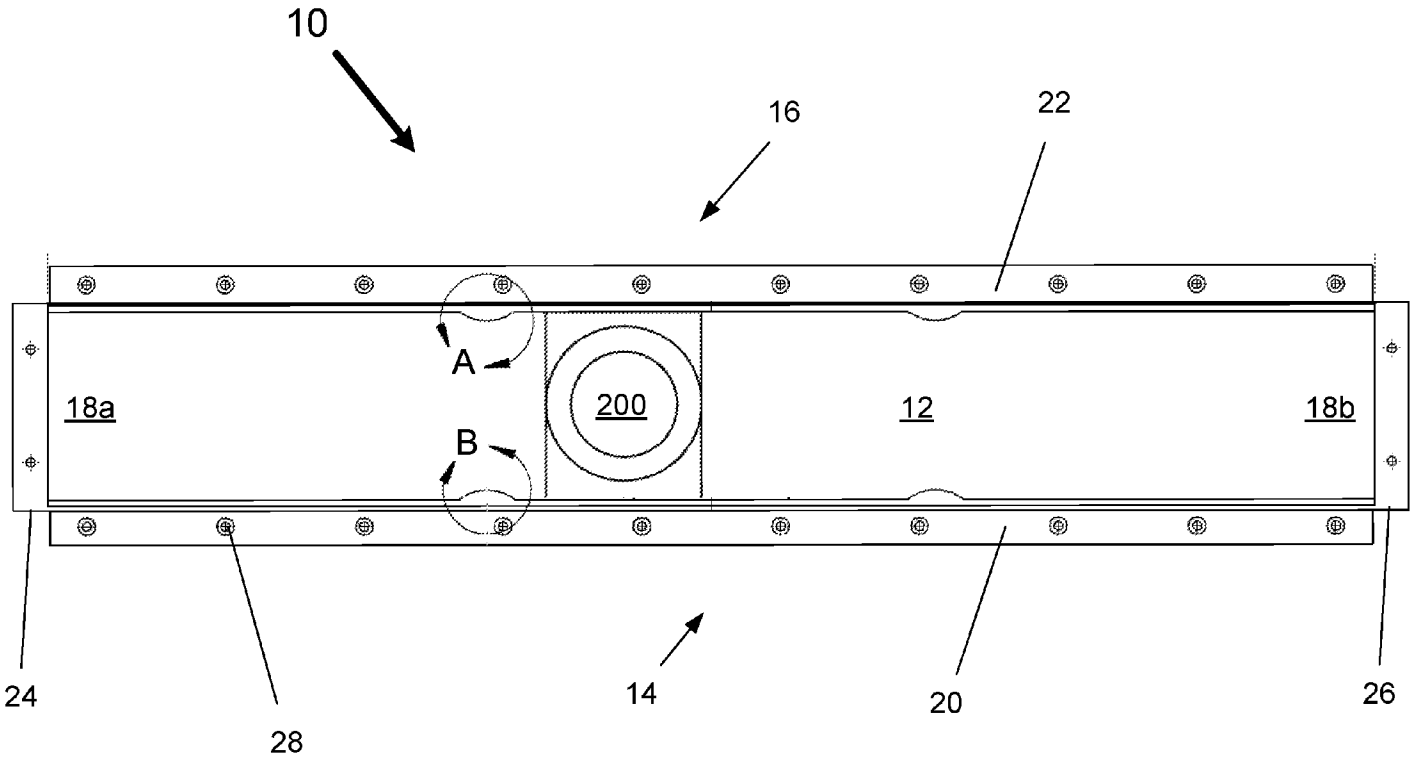
FIG. 11 shows a top view of a trench body with an off-center drain hole.

While the trench drain may be located at various locations within a shower 100, in one exemplary embodiment, the trench drain is installed at the front of the shower. Thus, all the draft 102 in the shower goes to the front, eliminating the need for understanding or dealing with shower draft. The drain hole 200 can be moved to the left or right (as seen in FIG. 11 and as noted above with regard to positioning in the bottom) in order to miss I-beam or other subfloor obstructions. This positioning also minimizes the number of transition points (transition from bathroom floor to trench drain, and from trench drain to shower floor/body 108), thereby making installation easier and reducing drainage and installation problems.

In some embodiments, with an absolute front location, the trench drain may serve as the drain for the entire bathroom. In other systems, a drain is located somewhere back into the shower some distance, creating several transitions (bathroom floor to shower floor, shower floor to drain, drain to shower floor) that impede proper mending and the ability for water to be directed to the drain properly.

The trench body may be of any size suitable for various installation, and commonly may be approximately 36 or 60 inches in length, although other lengths are possible. In one exemplary embodiment, the trench drain is 36.25 inches in length (38.125 inches in length, including the end flanges), and 5.6250 inches in width (not including flanges). The front flange is 0.1250 inches thick, while the back flange is 0.2500 inches thick. The front edge is 0.0625 inches thick (above the rim), and the back edge is 0.1250 inches thick (above the rim). Protrusions are located approximately 12 inches from each end, are approximately 1.5 inches long, and extend 0.25 inches into the interior of the trench body. In another exemplary embodiment, the trench drain is 60.25 inches in length (61.125 inches in length, including the end flanges), and 5.6250 inches in width (not including flanges). The front flange is 0.1250 inches thick, while the back flange is 0.2500 inches thick. The front edge is 0.0625 inches thick (above the rim), and the back edge is 0.1250 inches thick (above the rim). Protrusions are located approximately 19.5 inches from each end, are approximately 1.5 inches long, and extend 0.25 inches into the interior of the trench body. When installed, the invention of the present invention has a minimized threshold height of 0.75 inches or less.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A drain for a low-threshold shower, comprising:

a unitary rectangular drain body forming a shallow open box with a front side with a top, a back side with a top, a right side, a left side, a bottom, and an open top;

a drain hole extending through the bottom approximately midway between the right side and the left side, wherein the interior bottom of the drain body has a draft towards the drain hole from the left and right sides and the exterior bottom of the drain body is flat;

a flat front attachment flange extending from the front side of the drain body below the top of the front side, said flat front attachment flange further comprising at least two countersunk attachment holes extending therethrough;

a flat back attachment flange extending from the back side of the drain body below the top of the back side;

right and left attachment flanges extending from the right and left sides of the drain body, wherein the top of the right attachment flange and the top of the left attachment flanges are level and contiguous with the top of the front side and the top of the back side of the drain body; and a grate with a top and bottom and with lateral and longitudinal support members, wherein the grate fits within the open top of the drain body so that the top of the grate is level with the top of the front side and the top of the back side of the drain body, and further wherein the lateral support members do not form a continuous solid connection for water flow between the front side and back side of the drain body.

2. A drain for a low-threshold shower, comprising:

a rectangular drain body forming a shallow open box with a front side with a top, a back side with a top, a right side, a left side, a bottom, and an open top;

a drain hole extending through the bottom approximately midway between the right side and the left side, wherein the interior bottom of the drain body has a draft towards the drain hole from the left and right sides and the exterior bottom of the drain body is flat;

a flat front attachment flange extending from the front side of the drain body below the top of the front side;

a flat back attachment flange extending from the back side of the drain body below the top of the back side, further wherein the front attachment flange is thinner than the back attachment flange; and a grate with a top and bottom and with lateral and longitudinal support members, wherein the grate fits within the open top of the drain body, and further wherein the lateral support members do not form a continuous solid connection for water flow between the front side and back side of the drain body.

3. The drain of claim 2, wherein the front attachment flange is approximately 0.125 inches thick and the back attachment flange is approximately 0.25 inches thick.

4. The drain of claim 1, wherein the drain body is approximately 60 inches in length.

5. The drain of claim 1, wherein the drain body is approximately 36 inches in length.

6. The drain of claim 1, further comprising a lip extending inward from the front and back sides to support the grate.

7. The drain of claim 6, further comprising two or more curved protrusions extending inward from the lip on the front and back sides, contiguous with the lip.

8. A flush-threshold or low-threshold shower system, comprising:

a shower with a floor, two side walls, a back wall, and a front, located in a bathroom with a floor and subfloor;

a rectangular drain in the shower floor extending between the side walls of the shower, the drain comprising a unitary rectangular drain body forming a shallow open box with a front side with a top, a back side with a top, a right side, a left side, a bottom, and an open top;

a drain hole extending through the bottom approximately midway between the right side and the left side, wherein the interior bottom of the drain body has a draft towards the drain hole from the left and right sides and the exterior bottom of the drain body is flat;

a flat front attachment flange extending from the front side of the drain body below the top rim at an approximately 90 degree angle with respect to the front side;

a flat back attachment flange extending from the back side of the drain body below the top rim at an approximately 90 degree angle with respect to the back side;

right and left attachment flanges extending from the right and left sides of the drain body, wherein the top of the right and left attachment flanges are level and contiguous with the top of the front side and the top of the back side of the drain body; and a grate with a top and bottom and with lateral and longitudinal support members, wherein the grate fits within the open top of the drain body, and further wherein the lateral support members do not form a continuous solid connection for water flow between the front side and back side of the drain body;

wherein the right and left attachment flanges extend under the respective side walls of the shower.

9. The system of claim 8, wherein the drain extends across the front of the shower.

10. The system of claim 9, wherein the shower floor drafts from the back to the front of the shower.

11. The system of claim 8, wherein the drain hole is positioned off-center to miss subfloor obstructions.

12. The system of claim 8, wherein the outside of the bottom of the trench body is flat, and adapted to be installed on the subfloor without use of bedding compound or mudset.

13. The system of claim 8, wherein the front attachment flange is securely attached to subfloor.

* * * * *